US005720262A

United States Patent [19]

Antonioli et al.

[11] Patent Number: 5,720,262

[45] Date of Patent: Feb. 24, 1998

[54] DYNAMIC ELECTRONIC CONTROL SYSTEM FOR CONTROLLING THE INJECTION PRESSURE OF A RAIL INJECTION SYSTEM

[75] Inventors: Pierpaolo Antonioli; Alberto Pisoni, both of Turin, Italy

[73] Assignee: C.R.F. Societa Consortile per Azioni, Strada Torino, Italy

[21] Appl. No.: 776,120

[22] PCT Filed: Jul. 21, 1995

[86] PCT No.: PCT/IT95/00121

§ 371 Date: Jan. 22, 1997

§ 102(e) Date: Jan. 22, 1997

[87] PCT Pub. No.: WO96/03577

PCT Pub. Date: Feb. 8, 1996

[30] Foreign Application Priority Data

Jul. 22, 1994 [IT] Italy ..... TO94A0609

[51] Int. Cl.[6] ..... F02M 41/00

[52] U.S. Cl. ..... 123/458

[58] Field of Search ..... 123/446, 456, 123/457, 458, 511, 506; 364/431.051, 431.052

[56] References Cited

U.S. PATENT DOCUMENTS

| | | | |
|---|---|---|---|
| 5,058,553 | 10/1991 | Kondo et al. | 123/458 |
| 5,085,193 | 2/1992 | Morikawa | 123/458 |
| 5,094,216 | 3/1992 | Miyaki et al. | 123/456 |
| 5,197,438 | 3/1993 | Yamamoto | 123/506 |

FOREIGN PATENT DOCUMENTS

| | | |
|---|---|---|
| 0 501 463 | 9/1992 | European Pat. Off. . |
| 0 115 868 | 8/1994 | European Pat. Off. . |

OTHER PUBLICATIONS

"Application of H Optimal Design to Automative Fuel Control," Kuraoka et al., 1989 American Control Conference, vol. 3, 23 Jun. 1989, pp. 1957–1962.

"Generalized Gain Control of a Diesel Engine Based on H2 Optimization," Jiang, 1993 American Control Conference, vol. 1, 2 Jun. 1993, pp. 306–309.

"Sampled–data theory appliced to the modelling and control of compression–ignition engins–part II," Flower et al., International Journal of Control, vol. 13, No. 4, Apr. 1971, pp. 609–623.

*Primary Examiner*—Thomas N. Moulis

*Attorney, Agent, or Firm*—Evenson, McKeown, Edwards & Lenahan, P.L.L.C.

[57] ABSTRACT

An electronic system (1) for controlling the injection pressure of a fuel injection system (4) wherein a pump (8) supplies fuel at high pressure to a rail (17) presenting a number of outlets (19*a*, 19*b*, 19*c*, 19*d*) communicating with respective injectors (21*a*, 21*b*, 21*c*, 21*d*). The injection system (4) presents a pressure regulator (24) interposed between the outlet (8*a*) of the pump (8) and the inlet (17*a*) of the rail (17), and controlled by a drive signal (U(z)) generated by a regulator circuit (50); the regulator circuit (50) is supplied with a digital error signal (Err(z)) representing the difference between a signal (Pmis(z)) generated by a pressure sensor (38) in the rail, and a signal (Prif(z)) representing an optimum reference pressure; and the regulator circuit (50) presents a transfer function R(z) of type (1), where "a", Kc are calculated numeric coefficients, and z is a digital variable.

5 Claims, 2 Drawing Sheets

DYNAMIC ELECTRONIC CONTROL SYSTEM FOR CONTROLLING THE INJECTION PRESSURE OF A RAIL INJECTION SYSTEM

TECHNICAL FIELD

The present invention relates to a dynamic electronic control system for controlling the injection pressure of a rail injection system.

BACKGROUND ART

Control systems are known which provide for controlling the injection pressure of fuel supply systems wherein a pump supplies the fuel at high pressure (1000–1300 bar) to a rail presenting a number of outlets communicating with respective injectors.

Such supply systems also comprise a pressure regulator interposed between the pump outlet and the rail inlet, and communicating with a fuel return conduit.

Known control systems comprise an electronic control unit supplied with a first signal generated by a pressure sensor on the rail, and a second signal representing an optimum reference pressure, and which processes the input signals to generate a pressure regulator drive signal.

More specifically, known control systems comprise a proportional integral regulator P.I. which is supplied with an error signal e(t) representing the difference between the first and second signal, and generates the drive signal u(t) according to an expression of the type:

$$u(t)=Kp*e(t)+Ki*\int e(\theta)d\theta$$

where e(t) is the error; u(t) is the drive signal; and Kp, Ki are the proportional constant and integral constant respectively of the P.I. regulator.

Injection pressure control systems of the above type provide for only approximate control, which is ineffective under certain operating conditions of the fuel supply system.

Moreover, such known known systems are also subject to instability.

DISCLOSURE OF INVENTION

It is an object of the present invention to provide a system designed to overcome the aforementioned drawbacks typically associated with known systems.

According to the present invention, there is provided a dynamic control system for controlling the injection pressure of an internal combustion engine fuel injection system; said injection system comprising;

at least one pump for supplying fuel under pressure to a rail presenting a number of outlets communicating with respective injectors of said engine; and at least one pressure regulator interposed between the outlet of said pump and the inlet of said rail;

said pressure regulator communicating with at least one fuel return conduit;

said pressure control system comprising:

pressure sensing means located on said rail and generating a first signal (Pmis) correlated to the fuel pressure in the rail;

means for generating a second signal (Prif) correlated to an optimum pressure; and electronic controller means supplied with the first and second signal, and generating an output signal (U(z)) for driving the pressure regulator;

characterized in that said electronic controller means comprise regulating means supplied with a digital error signal (Err(z)) and generating said drive signal (u(z));

said digital error signal (Err(z)) being proportional to the difference between said first and second signal;

said regulating means presenting a sampled data transfer function R(z)=U(z)/Err(z) of the type:

$$R(z)=U(z)/Err(z)=K_c\cdot\frac{1+a}{1-a}\cdot\frac{z}{z-1}\cdot\frac{z-a}{z+a} \quad [1]$$

where:

z=a digital variable;

a=a numeric coefficient;

Kc=a proportional numeric coefficient.

BRIEF DESCRIPTION OF DRAWINGS

A preferred, non-limiting embodiment of the present invention will be described by way of example with reference to the accompanying drawings, in which.

BEST MODE FOR CARRYING OUT THE INVENTION

Figure 1:
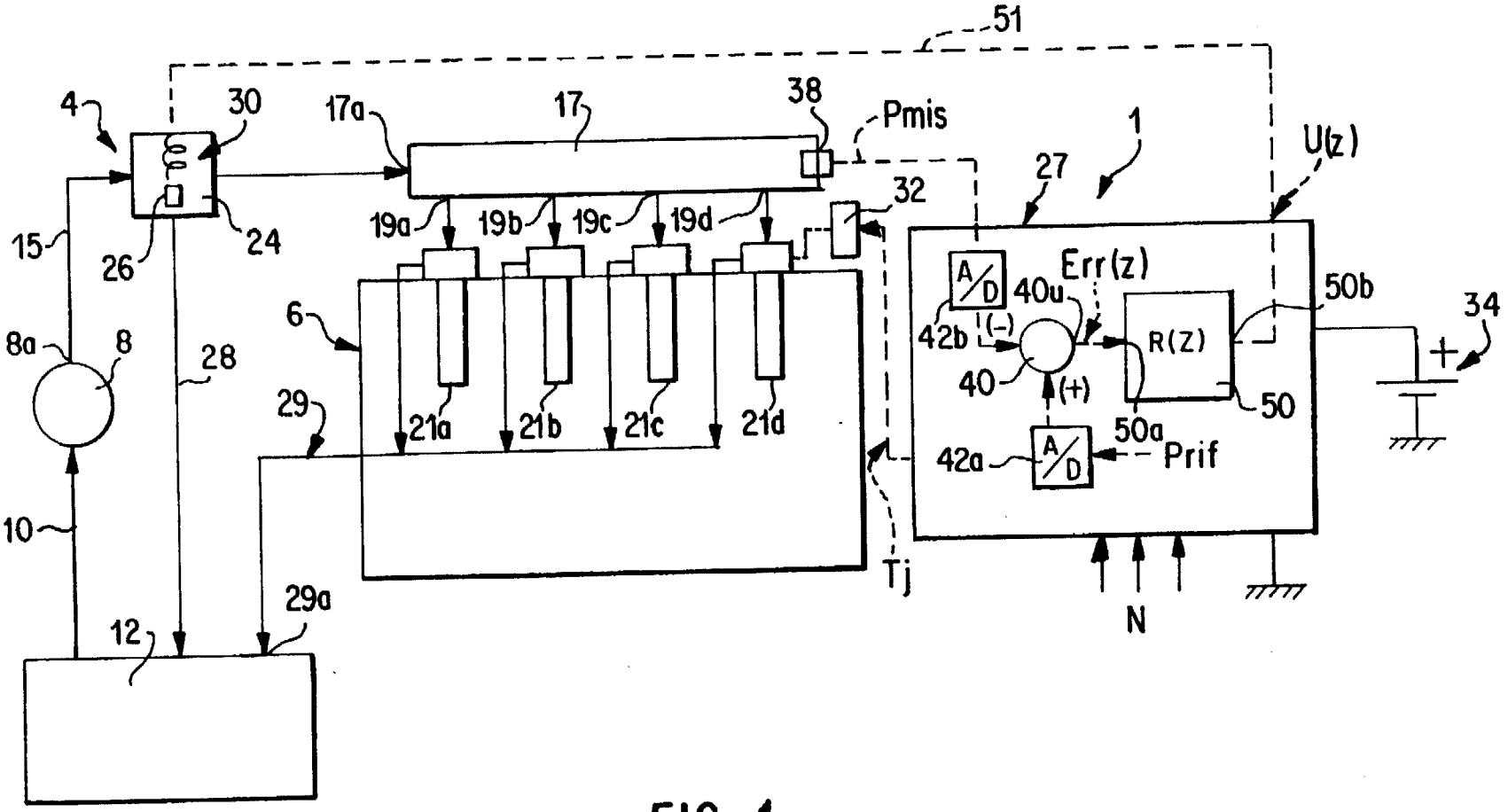
FIG. 1 shows a dynamic electronic injection pressure control system in accordance with the teachings of the present invention.

Number 1 in FIG. 1 indicates a dynamic electronic injection pressure control system applied to the injection system 4 of an internal combustion engine 6 (shown schematically), in particular a diesel engine.

Injection system 4 comprises an electric supply pump 8, the inlet of which is connected by a supply conduit 10 to a fuel tank 12, and the outlet **8*a* of which is connected by a high-pressure (1000–1300 bar) supply line 15 to the inlet 17*a* of a known rail 17**.

Rail 17 presents a number of outlets **19*a*, 19*b*, 19*c*, 19*d* communicating with respective injectors 21*a*, 21*b*, 21*c*, 21*d* of engine 6** (common rail).

Injection system 4 also comprises a pressure regulator 24 located along high-pressure line 15 and preferably consisting of a two-way solenoid valve controlled by an electronic control unit 27. More specifically, solenoid valve 24 comprises an electric winding 30 (shown schematically) for axially displacing a shutter 26 (also shown schematically).

Pressure regulator 24 also communicates with a first fuel return conduit (bypass) 28 terminating in tank 12.

Injection system 4 also comprises a second fuel return conduit 29 presenting inlets communicating with recirculating outlets of injectors **21*a*–21*d*, and an outlet 29*a* connected to tank 12**.

Electronic control unit 27 is supplied by an electric battery 34 which also supplies the various electric devices (not shown) cooperating with engine 6.

Control unit 27 is supplied with a number of information signals N detected on the engine (e.g. relative to engine speed, pressure in the intake manifold (not shown), position of the accelerator (not shown), etc.), and generates a number of control signals Tj for controlling injectors **21*a*–21*d* after being decoded and amplified by a power circuit 32**.

According to the present invention, control unit 27 is supplied with a first pressure signal Pmis generated by a pressure sensor 38 on rail 17, and with a second signal Prif representing an optimum reference pressure, e.g. obtained from an electronic table (not shown) or entered manually. Control unit 27 comprises an adding node 40 presenting an adding input (+) and a subtracting input (−) supplied respectively with signals Prif and Pmis digitized by A/D sampling units 42*a*, 42*b* (shown schematically).

Adding node 40 presents an output 40*u* by which a digital error signal Err(z) is supplied to the input 50*a* of a regulating circuit 50 which also presents an output 50*b* generating a digital signal U(z) for driving solenoid valve 24, and communicating over electric line 51 with a control circuit (not shown) of solenoid valve 24.

According to the present invention regulating circuit 50 presents a transfer function R(z), defined by the ratio between output signal U(z) and input signal Err(z), of the type $$R(z) = U(z)/Err(z) = K_c \cdot \frac{1+a}{1-a} \cdot \frac{z}{z-1} \cdot \frac{z-a}{z+a} \quad [1]$$

where:

z=a digital variable;

a=a computable numeric coefficient;

Kc=a proportional numeric coefficient of a value ranging between a lower limit Kc-min and an upper limit Kc-max.

More specifically, coefficient Kc is calculated according to the expression:

$$Kc = \frac{1}{\frac{K_t}{S_{nozzle}} \cdot \frac{V_{batt}}{R_L}} \cdot 2\pi f_c T \quad [2]$$

where:

Kt is the proportion constant relating the force

Find acting on shutter 26 of regulator 24 to the current Il through winding 30, i.e.

$$Find = Kt * Il; \quad (3)$$

$S_{nozzle}$ is the section of the regulator 24 nozzle (not shown) from which the pressurized fuel issues;

$V_{batt}$ is the voltage of battery 34;

RL is the parasitic resistance of winding 30 of pressure regulator 24;

T is the sampling time of control unit 27; and fc is the frequency at which the product R(z)*G(z) of the transfer function R(z) of regulator 50 and the transfer function G(z) of the input/output system comprising pump 8, rail 17 and solenoid valve 24 presents a unit gain.

Numeric coefficient "a" is calculated according to the expression:

$$a = e^{-T(Ku \cdot \frac{X_{shutter,balance}}{2\sqrt{P_{fuel,balance}}} \cdot \frac{1}{C_{rail}})} \quad [4]$$

where:

Ku is a proportion coefficient;

T is the sampling time of control unit 27;

$X_{shutter,balance}$ is the position of shutter 26 of regulator 24 at which fuel is fed to return conduit (bypass) 28;

$P_{fuel,balance}$ is the fuel pressure in rail 17;

$C_{rail}$ is the hydraulic capacity of rail 17.

An explicit statement of (1) gives the formula physically implemented by regulator circuit 50, i.e.

$$U(i) = K_c \frac{1+a}{1-a} Err(i) - \quad [5]$$

-continued $$K_c \frac{1+a}{1-a} aErr(i-1) + aU(i-z) + (1+a)U(i-1)$$

where i represents the sampling instant, and Kc, Z and "a" are defined beforehand.

Figure 2:
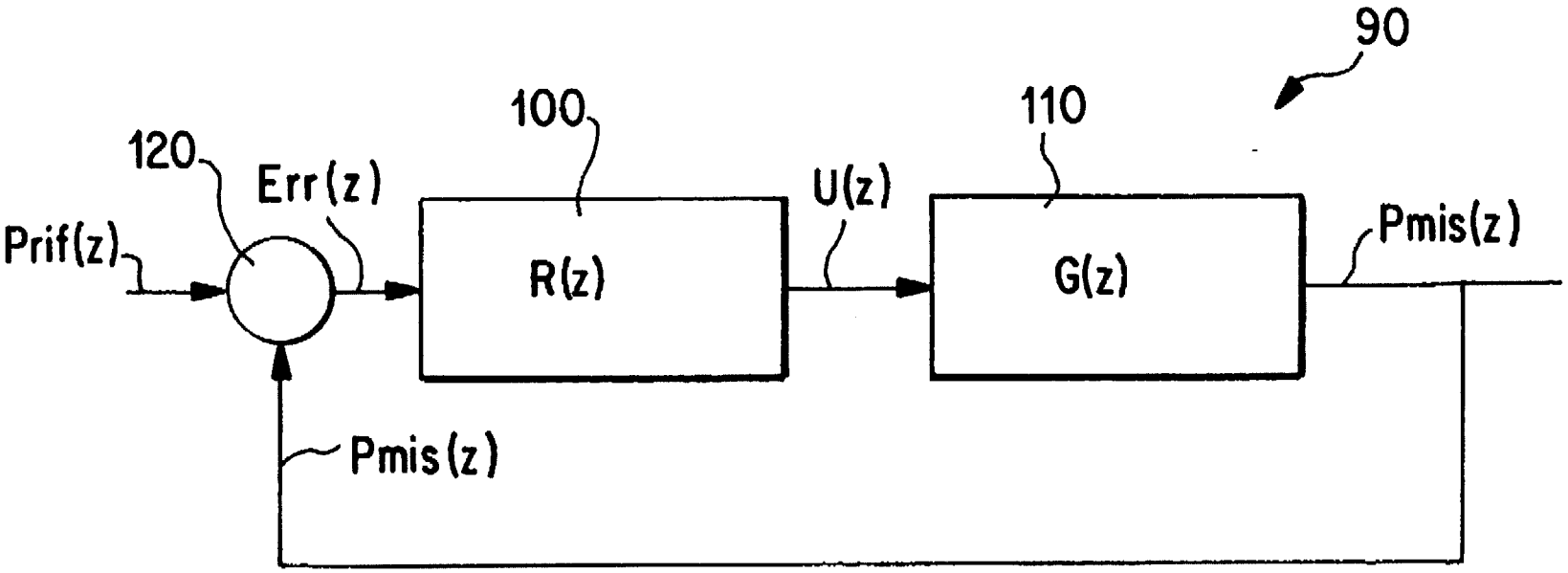
FIG. 2 shows a logic block diagram illustrating physical-mathematical operation of the control system according to the present invention.

A rough description will now be given, with reference to FIG. 2, of how expression (1) was obtained.

The physical system composed of pump 8, rail 17 and solenoid valve 24 may be represented as a sampled data input-output system with the control signal of solenoid valve 24 (signal U(z)) as the input, and the pressure signal. Pmis(z) as the output; which input-output system was modelized by means of a number of state equations which were combined to give an overall transfer function G(z) defined as the ratio between the output and input, i.e. G(z)=Pmis(z)/U(z).

Injection system 4 and control system 1 form a feedback system 90 (FIG. 2) which may be represented schematically by a first block 100 defining the transfer function R(z) of regulator 50, and a second block 110 input-connected to the output of first block 100 and representing the physical input-output system described by transfer function G(z).

The first block 100 also presents an input communicating with an adding node 120 supplied with the reference pressure signal Prif(z) and the feedback signal Pmis(z) from the output of block 110.

A number of control specifications were established for calculating (1):

(a) the step response error of system 90 must be substantially zero, i.e. when excited by a step Prif(z), system 90 must respond immediately, and the output of the system Pmis (z) must switch to a steady-state value after a rapid transient state;

(b) the rise time Ts of system 90 must be less than a predetermined number of seconds, e.g. 0.5 (rise time Ts is defined as the time taken by the output (Pmis) of a controlled system to switch from 10% to 90% of the steady-state value following an excitation step—see A.ISIDORI, Control Systems, SIDEREA, ROME 1979, p. 114);

(c) the maximum overshoot s of the output of system 90 must be less than a percentage value, e.g. 5%.

Overshoot s is defined as the maximum amount by which system response deviates from the steady-state value (see A.ISIDORI, Control Systems, SIDEREA, ROME 1979, p. 114).

Conformance with condition (a) means that, as shown by systems theory studies (e.g. A.ISIDORI, Control Systems, SIDEREA, ROME 1979), transfer function R(z) must have one pole in the origin, i.e. must comprise at least one block Cl of the type:

$$C1 = (z)/(z-1) \quad (6)$$

As regards specification (b), it is important to remember that rise time Ts is related to the passband Bp of system 90 in the closed-loop configuration by the empirical equation (A. ISIDORI, Control Systems, SIDEREA, ROME 1979, p. 119):

$$Bp * Ts = 3 \quad (7)$$

where Ts is the rise time, and Bp the passband of the system in the closed-loop configuration.

Equation (7) permits the passband Bp of the system in the closed-loop configuration to be obtained after establishing rise time Ts.

The upper limit of the passband of the system is defined as twice the frequency at which transfer function R(z),G(z) intersects the zero axis dB on a Bode diagram, so that, once Bp is established, fc=1/2Bp.

After calculating passband Bp according to equation (7), gain Kc of the system for achieving the calculated passband in the worst possible case is calculated.

Specification (b) thus gives a minimum value Kcmin of gain Kc of regulator circuit 50.

The gain of regulator circuit 50 also presents an upper limit Kcmax which is defined according to the extent to which system 90 is effected by noise. More specifically, the upper limit Kcmax defined is that above which interference in the output quantity (Pmis(z)) results in impaired stability of the system.

Overshoot s is related to the resonance modulus Mr in the closed-loop configuration by the equation (see A.ISIDORI, Control Systems, SIDEREA, ROME 1979, p. 119):

$$1+s=0.85Mr \tag{8}$$

For example, when s=5%, a minimum phase margin of roughly 60° is required at frequency fc.

Since system 90 in the open-loop configuration (R(z)*G(z)) naturally presents a phase approximating the value (−180°) at which instability occurs, regulator 50 R(z) must be provided with a block C2 for introducing the required phase shift (in the example, roughly 60°), i.e. a block of the type:

$$C2=\frac{1+a}{1-a}\cdot\frac{z-a}{z+a} \tag{9}$$

The composition of (6) and (9) and proportional constant Kc defined as described above therefore gives transfer function R(z).

The advantages of the present invention will be clear from the foregoing description. In particular, the system described features a regulator 50 implementing a transfer function R(z) calculated by means of a model of the physical system (block 110) simulating performance of the injection system, so that system 1 provides for faithfully reproducing the control specifications.

System 1 also presents a wide margin of stability and a wide passband.

The stability of system 1 is full-range, i.e. system 1 remains stable regardless of variations in the parameters of the physical system.

All the coefficients (a, Kc) employed in the system according to the present invention are calculated directly, thus eliminating time-consuming (and high-cost) experimentation required for determining the coefficients according to the known state of the art.

Clearly, changes may be made to the system as described and illustrated herein without, however, departing from the scope of the present invention.

We claim:

1. A dynamic control system for controlling the injection pressure of an internal combustion engine fuel injection system (4);

said injection system (4) comprising;

at least one pump (8) for supplying fuel under pressure to a rail (17) presenting a number of outlets (19*a*, 19*b*, 19*c*, 19*d*) communicating with respective injectors (21*a*, 21*b*, 21*c*, 21*d*) of said engine (6); and at least one pressure regulator (24) interposed between the outlet (8*a*) of said pump (8) and the inlet (17*a*) of said rail (17);

said pressure regulator (24) communicating with at least one fuel return conduit (28);

said pressure control system (1) comprising:

pressure sensing means (38) located on said rail (17) and generating a first signal (Pmis) correlated to the fuel pressure in the rail (17);

means for generating a second signal (Prif) correlated to an optimum pressure; and electronic controller means (27) supplied with the first and second signal, and generating an output signal (U(z)) for driving the pressure regulator (24);

characterized in that said electronic controller means (27) comprise regulating means (50, 100) supplied with a digital error signal (Err(z)) and generating said drive signal (U(z));

said digital error signal (Err(z)) being proportional to the difference between said first and second signal;

said regulating means (50, 100) presenting a sampled data transfer function R(z)=U(z)/Err(z) of the type:

$$R(z)=U(z)/Err(z)=K_c\frac{1+a}{1-a}\cdot\frac{Z}{Z-1}\cdot\frac{Z-a}{Z+a} \tag{1}$$

where:

z=a digital variable;

a=a numeric coefficient;

Kc=a proportional numeric coefficient.

2. A system as claimed in claim 1, characterized in that said proportional numeric coefficient Kc is calculated according to an expression of the type:

$$Kc=\frac{1}{\frac{K_t}{S_{nozzle}}\cdot\frac{V_{batt}}{R_L}}\cdot 2\pi fc\cdot T \tag{2}$$

where:

Kt is the proportion constant relating the force (Find) acting on the shutter (26) of said pressure regulator (24) to the current (Il) through the winding (30) of the regulator (24);

$S_{nozzle}$ is the section of the nozzle (25) of said regulator (24) from which the pressurized fuel issues;

$V_{batt}$ is the voltage of the battery (34) supplying said electronic controller means (27);

RL is the parasitic resistance of the winding (30) of said regulator (24);

T is the sampling time of said electronic controller means (27); and fc is the frequency at which the product R(z)*G(z) of the transfer function R(z) of said regulator (50) and the transfer function G(z) of the input/output system comprising said pump (8), said rail (17) and said pressure regulator (24) presents a unit gain.

3. A system as claimed in claim 1, characterized in that said numeric coefficient is calculated according to the expression:

$$a=e^{-T(Ku\cdot\frac{X_{shutter,balance}}{z\sqrt{P_{fuel,balance}}}\cdot\frac{1}{C_{rail}})} \tag{4}$$

where:

Ku is a proportion coefficient;

T is the sampling time of said electronic controller means (27);

$X_{shutter,balance}$ is the position of the shutter (26) of said regulator (24) at which fuel is fed to said return conduit (28);

$P_{fuel,balance}$ is the fuel pressure in said rail (17);

$C_{rail}$ is the hydraulic capacity of said rail (17).

4. A system as claimed in claim 1, characterized in that said regulating means (50, 100) implement a formula of the type:

$$U(i) = Kc * \frac{1+a}{1-a} \cdot Err(i) - K_c \frac{1+a}{1-a} \cdot aErr(i-1) + aU(i-z) + (1+a)U(i-1)$$

where i represents the sampling instant, "a" is a numeric coefficient, and Kc is a proportional numeric coefficient.

5. A system as claimed in claim 2, characterized in that said numeric coefficient is calculated according to the expression:

$$a = e^{-T(Ku \cdot \frac{X_{shutter,balance}}{2\sqrt{P_{fuel,balance}}} \cdot \frac{1}{C_{rail}})}$$

where:

Ku is a proportion coefficient;

T is the sampling time of said electronic controller means;

$X_{shutter,balance}$ is the position of the shutter of said regulator at which fuel is fed to said return conduit;

$P_{fuel,balance}$ is the fuel pressure in said rail;

$C_{rail}$ is the hydraulic capacity of said rail.

* * * * *